United States Patent [19]

Hirbod

[11] 4,278,425

[45] Jul. 14, 1981

[54] CERAMIC KILN SUPPORT APPARATUS

[76] Inventor: Farrokh Hirbod, 149 N. Rexford Dr., Beverly Hills, Calif. 90210

[21] Appl. No.: 141,859

[22] Filed: Apr. 21, 1980

[51] Int. Cl.[2] ..... F27D 5/00

[52] U.S. Cl. ..... 432/259; 294/16

[58] Field of Search ..... 432/258, 259; 294/16

[56] References Cited

U.S. PATENT DOCUMENTS

| | | | |
|---|---|---|---|
| 2,927,362 | 3/1960 | Dopera | 432/259 |
| 4,136,449 | 1/1979 | Penrod et al. | 432/258 |

*Primary Examiner*—John J. Camby

*Attorney, Agent, or Firm*—Nilsson, Robbins, Dalgarn, Berliner, Carson & Wurst

[57] ABSTRACT

A ceramic support apparatus for supporting and holding a ceramic article in a kiln while the ceramic article is being fired has first and second bowed ceramic members pivotally mounted on a ceramic rod with their respective concavities in non-facing orientation. Each bowed ceramic member has an upper hooked end for hooking over the edge of a support flange in the kiln and a lower hooked end for hooking under a support lip of the ceramic article whereby the article may be hung from the support flange in the kiln. The lower hooked end may have one or more cusps extending upwardly for contacting the support lip of the ceramic article. A pair of hooked members may also be provided to be rotated into a position under the support lip and thereafter attached over each end of the ceramic rod to be held thereby. The ceramic article is thereby supported at four different locations about the circumference of the support lip.

4 Claims, 4 Drawing Figures

CERAMIC KILN SUPPORT APPARATUS

BACKGROUND OF THE INVENTION

The present invention relates to ceramics and in particular to a ceramic support apparatus whereby a ceramic article may be supported in the interior of a kiln while the ceramic article is being fired without creating blemishes in the observable part of the ceramic article.

The making of a ceramic article generally involves providing a ceramic material which is first hardened by drying and then bisque-firing it. Thereafter, a glaze is applied over the exterior surface of the article. The glazed ceramic object is finally glaze-fired in a kiln at extremely high temperatures up to about 2500 degrees Fahrenheit or more.

Many types of ceramic articles can be fired by simply placing the article on a shelf inside the kiln. However, certain shapes of ceramic objects such as, for example, egg shaped objects or certain types of bowls, require the use of some type of support so that they will not roll or otherwise move during the firing process. In general, when such a support is required in the prior art, a small ceramic tripod-like device with upwardly extending support cusps at each corner of the tripod device is used to prevent the ceramic article from rolling or to otherwise support the ceramic article on the tripod-like device. However, such devices suffered the disadvantage of having to make contact with the surface of the ceramic object at an outside location which could be seen by an observer. After the ceramic article was fired, the tripod-like device had to be dislodged from the outside location of the ceramic article frequently causing unsightly damage to the article or at the least causing three small blemishes at the point where the tripod-like device made contact with the ceramic article. Such blemishes detract from the aesthetic value of such objects.

Consequently, it is desired to provide a new type of ceramic support apparatus by which a ceramic article can be supported inside a kiln during firing without leaving unsightly blemishes at tripod support locations which can be observed when the ceranic article is placed on display. The present invention provides such a device whereby the ceramic article is supported, not at an external observable location, but at an inside location where any blemish which does occur will be hidden and therefore not observable when the article is put on display.

SUMMARY OF THE INVENTION

The invention comprises a ceramic support apparatus for supporting a ceramic article in a kiln during firing. The kiln is provided with an elevated first support flange and an elevated second support flange horizontally spaced from the first support flange. The ceramic support apparatus comprises a first and a second bowed ceramic member and a ceramic rod to which the first and second bowed ceramic members are pivotally mounted. Specifically, the first bowed ceramic member has a first hooked end for engaging the support lip of the ceramic article at a first region, a second hooked end for hooking over the first support flange, and a first orifice through the first bowed ceramic member at a location between the second hooked ends. The second bowed ceramic member likewise has a third hooked end for engaging the support lip of the ceramic article at a second region opposite the first region, a fourth hooked end for hooking over the second support flange, and a second orifice through the second bowed ceramic member at a location between the third and fourth hooked ends. The ceramic rod is then provided to extend through the first and second orifices for pivotally mounting the first and second bowed members to the ceramic rod. The direction of bowing, that is, direction of concavity, of the first bowed ceramic member is opposite to the direction of bowing (concavity) of the second bowed ceramic member.

In the preferred embodiment, at least one cusp extends from each of the first and third hooked ends of the first and second bowed support members respectively for providing a contact point at which the first and second bowed support members contact the support lip of the ceramic article.

The ceramic support apparatus may also include a first hook member and a second hook member. The first hook member has a hooked end for engaging the support lip of the ceramic article at a third region between the first and the second regions, and a first attachment end having an orifice therethrough whereby the first hook member can be mounted along the ceramic rod at a location so that the hooked end engages the support lip of the ceramic article.

The second hook member likewise has a hooked end for engaging the support lip of the ceramic article at a fourth region opposite the third region and between the first and second regions, and a second attachment end having an orifice therethrough whereby the second hook member may be mounted onto the ceramic rod adjacent the second bowed ceramic member.

In the preferred embodiment, at least one cusp is provided to extend from each of the hooked ends of the first and second hook members, respectively, for providing a point of contact between the hook members and the support lip of the ceramic article at the third and fourth regions thereof, respectively.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

Figure 1:
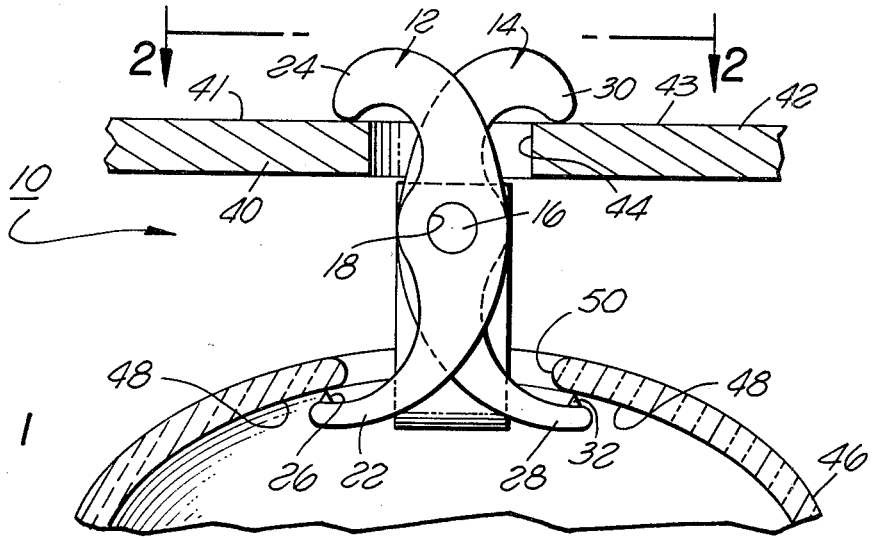
FIG. 1 is a side cross-sectional view of a ceramic support apparatus in position between a pair of support flanges and a ceramic article whereby the ceramic support apparatus provides a connecting support link between the support flanges and the ceramic article.
Figure 2:
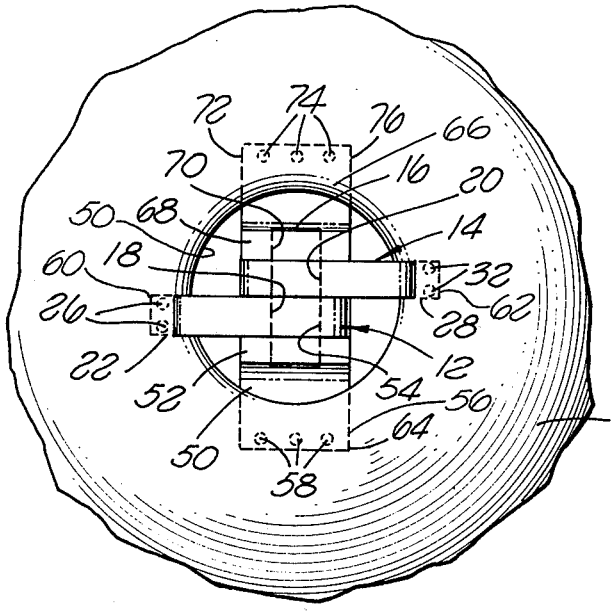
FIG. 2 is a top view of the ceramic support apparatus illustrated in FIG. 1.

Referring to FIGS. 1 and 2, a ceramic support apparatus 10 comprises a first bowed ceramic member 12 and a second bowed ceramic member 14 pivotally mounted to a ceramic rod 16. The ceramic rod 16 extends through an orifice 18 in the first bowed ceramic member 12 and an orifice 20 in the second bowed ceramic member 14.

Figure 3:
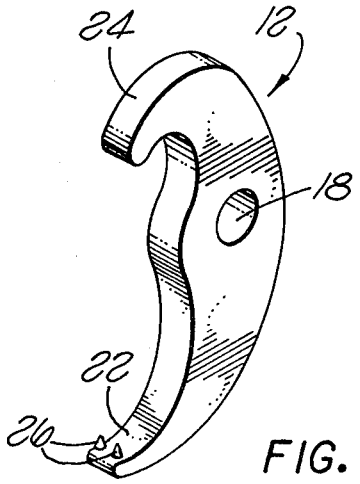
FIG. 3. is a detailed perspective view of the first bowed ceramic member shown in FIG. 1.

Referring to FIG. 3 in conjunction with FIGS. 1 and 2, the first bowed ceramic member 12 has a first hooked end 22 and a second hooked end 24 opposite the first hooked end 22. In the preferred embodiment, the first hooked end 22 has at least one cusp but preferably several cusps 26, extending toward the second hooked end 24 of the first bowed ceramic member 12.

Similarly, the second bowed ceramic member 14 has a third hooked end 28 and a fourth hooked end 30 opposite to the third hooked end 28. At least one, and preferably several, cusps 32 are positioned to extend from the third hooked end 28 of the second bowed ceramic member 14 in the direction of the fourth hooked end 30 of the second bowed ceramic member 14.

When the first bowed ceramic member 12 and the second bowed ceramic member 14 are positioned on the ceramic rod 16, the concavity of the first bowed ceramic member 12 is oriented to face in the opposite direction of the concavity of the second bowed ceramic member when the first hooked end 22 and the third hooked end 28 are positioned opposite one another so that the cusp 26 and the cusp 32 extend in the same direction from the first hooked end 22 and the third hooked end 28, respectively.

The support apparatus 10 is used in a kiln which can reach temperatures exceeding cone 11. Hence, the support apparatus must be made out of a ceramic material which has itself been fired at temperatures of about one to two cone higher than the firing temperature to be utilized in firing the ceramic article. In order to utilize the ceramic support apparatus 10 in accordance with the invention, a first support flange 40 and a second support flange 42 are provided at an elevated location inside the kiln. The first and second support flanges 40 and 42 may, for example, be simply a ceramic shelf with a slot therethrough or alternatively may be two separate ceramic shelves positioned in horizontally spaced relationship to one another. In any event, the first and second support flanges 40 and 42 are at an elevated position in the kiln and are horizontally spaced from one another with a slot of 44 therebetween.

The second hooked end 24 of the first bowed ceramic member 12 is then hooked over the edge and positioned to rest on the top surface 41 of the first support flange 40 with the first bowed ceramic member 12 extending downward through the slot 44.

Similarly, the fourth hooked end 30 of the second bowed ceramic member 14 likewise hooks over the edge and rests on the top surface 43 of the second support flange 42 so that the second bowed ceramic member 14 extends downward through the slot 44.

The ceramic support apparatus 10 may then be used to support a ceramic article 46 provided the ceramic article 46 has an orifice about which a support lip 48 exist. Thus, in the illustration of FIG. 1, the ceramic article 46 is egg shaped with an orifice 50 through one end. Of course, it will be appreciated that the ceramic support apparatus 10 may be used to support a dish, bowl, or other similar ceramic object in an upside down manner provided the base of the bowl, dish, or other ceramic object has an inwardly directed lip about its bottom peripheral edge. In any event, the first and second bowed ceramic member 12 and 14 are pivoted about the ceramic rod 16 until the spacing between the first and third hooked ends 22 and 28 is at a minimum. The first and third hooked ends 22 and 28 are then inserted through the orifice 50 and the first and second bowed ceramic members 12 and 14 are pivoted about the ceramic rod 16 so that the spacing between the first and third hooked ends 22 and 28 increases until the cusps 26 and 32 engage the support lip 48 of the ceramic article 46. The second hooked end 24 and the fourth hooked end 30 are then ready to be supported by the first support flange 40 and the second support flange 42 respectively. As previously indicated, because the cusps 26 and 32 support the ceramic pot 46 during firing of the ceramic article 46 and because the point at which the cusps 26 and cusps 32 engage the support lip 48 is on the inside of the ceramic article 46, the outside of the ceramic article 46 is left unblemished.

Figure 4:
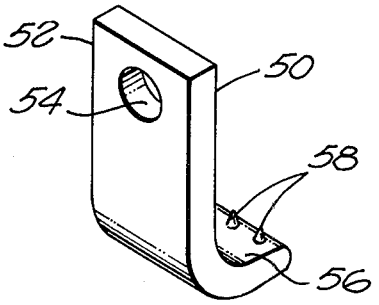
FIG. 4 is a detailed perspective view of the first hook member shown in FIG. 2.

Referring again to FIGS. 1 and 2 as well as FIG. 4. The ceramic support apparatus 10 may further comprise a first hook member 50 having an attachment end 52 with an orifice 54 therethrough and a hooked end 56 opposite the attachment end 52 with a plurality of cusps 58 extending from the hooked end 56 generally in the direction of the attachment end 52. In the preferred embodiment, the hook member 50 is generally curved with a shape somewhat similar to the first and second bowed ceramic members 12 and 14.

In operation, the hooked end 56 of the first hook member 50 is first inserted through the orifice 50 of the ceramic article 46. The first hook member 50 is then rotated until the ceramic rod 16 can be inserted through the orifice 54. The first hook member 50 can then be adjusted inwardly or outwardly along the ceramic rod 16 until the cusps 58 engage the support lip 48 of the ceramic article 46.

Thus, the cusps 26 will engage the support lip 48 of the ceramic article 46 at a first region 60, the cusps 32 will engage the support lip 48 of the ceramic article 46 at a second region 62 opposite to the first region 60 and the cusps 58 will engage the support lip 48 of the ceramic article 46 at a third region 64 between the first region 60 and the second region 62.

In a similar manner, a second hook member 66 has an attachment end 68 with an orifice 70 therethrough and a hooked end 72 with at least one and preferably several cusps 74 which extend from the hooked end 72 generally in the direction of the attachment end 68. The hooked end 72 of the second hook member 66 is inserted through the orifice 50 of the ceramic article 46 with the second hook member 66 being rotated until the second hook member 66 can be inserted over the ceramic rod 16 with the rod 16 extending through the orifice 70. The second hook member 66 is then positioned inwardly or outwardly on the ceramic rod 16 until the cusps 74 engage the support lip 48 at a fourth region 76 of the support lip 48 where the fourth region 76 is opposite to the third region 64. Thus, the first region 60 the second region 62 the third region 64 and the fourth region 76 are spaced 90 degrees from one another about the support lip 48 inside the ceramic article 46.

Of course, it will be appreciated that the first hook member 50 and the second hook member 66 are not absolutely essential in the present invention but are preferable to allow the ceramic article 46 to be supported from as many locations about the support lip 48 as possible to thereby decrease the amount of weight of the ceramic article 46 supported by any single cusp. It will also be appreciated that the first hook member 50 and the second hook member 66 are also made out of the ceramic material to withstand the high temperatures inside the kiln.

Thus, there has been described a novel ceramic support apparatus 10 in accordance with the invention whereby a ceramic article 46 having a support lip can be supported by the support lip at a location which is not otherwise observed so that when the ceramic article is ultimately put on display, the blemishes caused by the cusps in prior art tripod-like support apparatus are eliminated.

Of course, it will be appreciated that many changes, alterations and specific configurations are possible and all such alternations are intended to be within the scope and spirit of the invention.

What is claimed is:

1. A ceramic support apparatus for supporting and holding a ceramic article having a support lip in a kiln having an elevated first support flange and an elevated second support flange horizontally spaced from the first support flange while the ceramic article is being fired, the ceramic support apparatus comprising:

a first bowed ceramic member having a first hooked end for engaging the support lip of the ceramic article at a first region, a second hooked end for hooking over the first support flange and a first orifice through the first bowed ceramic member at a location between the first and second hooked ends;

a second bowed ceramic member having a third hooked end for engaging the support lip of the ceramic article at a second region opposite the first region, a fourth hooked end for hooking over the second support flange, and a second orifice through the second bowed ceramic member at a location between the third and fourth hooked ends; and a ceramic rod extending through the first and second orifices for pivotally mounting the first and second bowed members to the ceramic rod, with the direction of bowing of the first bowed ceramic member being opposite to the direction of bowing of the second bowed ceramic member.

2. The ceramic support apparatus of claim 1 further comprising at least one cusp extending from each of the first and third hooked ends of the first and second bowed support members respectively for contacting the support lip of the ceramic article.

3. The ceramic support apparatus of claims 1 or 2 further comprising:

a first hook member having a fifth hooked end for engaging the support lip of the ceramic article at a third region between the first and second regions, and a first attachment end having a third orifice therethrough for mounting the first hook member over the ceramic rod adjacent the first bowed ceramic member; and a second hook member having a sixth hooked end for engaging the support lip of the ceramic article at a fourth region opposite the third region and between the first and second regions, and a second attachment end having a fourth orifice therethrough, for mounting the second hook member over the ceramic rod adjacent the second bowed ceramic member.

4. The ceramic support of claim 3 further comprising at least one cusp extending from each of the fifth and sixth hooked ends of the first and second hook members respectively for contacting the support lip of the ceramic article.

* * * * *